United States Patent [19]

Broadhurst

[11] Patent Number: 5,025,641

[45] Date of Patent: Jun. 25, 1991

[54] MODULAR ICE MACHINE

[76] Inventor: John A. Broadhurst, Route 1, Box 180, Argyle, Tex. 76226

[21] Appl. No.: 315,307

[22] Filed: Feb. 24, 1989

[51] Int. Cl.[5] ..... F25C 1/12

[52] U.S. Cl. ..... 62/347; 239/553

[58] Field of Search ..... 62/347, 348, 352; 239/553, 553.3, 556, 557

[56] References Cited

U.S. PATENT DOCUMENTS

| | | | |
|---|---|---|---|
| 2,616,271 | 11/1952 | Knowles | 62/106 |
| 2,637,177 | 5/1953 | Reedall | 62/114 |
| 2,657,547 | 11/1953 | Heuser | 62/107 |
| 3,144,755 | 8/1964 | Kattis | 62/137 |
| 3,164,968 | 1/1965 | Mullins, Jr. | 62/73 |
| 3,330,128 | 7/1967 | Wilson | 62/137 |
| 3,430,452 | 3/1969 | Dedricks et al. | 62/138 |
| 3,929,256 | 12/1975 | Solomon | 221/81 |
| 4,192,151 | 3/1980 | Carpenter | 62/320 |
| 4,324,109 | 4/1982 | Garland | 62/353 |
| 4,365,485 | 12/1982 | Samuelsen | 62/320 |
| 4,531,380 | 7/1985 | Hagen | 62/320 |
| 4,549,408 | 10/1985 | Lee et al. | 62/320 |
| 4,589,261 | 5/1986 | Ohashi et al. | 62/73 |
| 4,590,774 | 5/1986 | Povainuk | 62/347 |
| 4,596,120 | 6/1986 | Knodel | 62/59 |
| 4,651,537 | 3/1987 | Hagen | 62/320 |
| 4,694,656 | 9/1987 | Lane et al. | 62/72 |

*Primary Examiner*—William E. Tapolcai

*Attorney, Agent, or Firm*—Matthews & Associates

[57] ABSTRACT

An apparatus and method of making extremely pure high quality flake ice, said apparatus having a frame manufactured completely of a food grade polyethylene thermal plastic material with slidably mounted hydrostatic distributor, slidably mounted freezing plates and, ice slides which direct the ice into an ice conveyor means for removing the ice from within the frame work of the apparatus, the method includes running a freon gas/liquid mixture into the freezing plates, ice making water being introduced into the system flowing onto freezing plates, the ice shavings and meltings from manufacturing the ice are being combined with tap water and recirculated for use in making additional ice, the refrigerant is pumped into the plates through a compressor, boiled off inside the plates such that a combined liquid/vapor mixture falls from the plates through a section header, excess liquid is then dumped into an accumulated, the refrigerant vapor is drawn off the top of the accumulator and in turn is transported to the compressor, the compressor takes the low pressure vapor and increases it's pressure and temperature, the hot high pressure gas is then forced from the compressor and into a water cooled condenser and then formed into a liquid, the liquid is then transferred to the accumulator and the accumulator using freon cools the liquid, this cool liquid and the freon then travel into the freezing plates and used to lower the temperature of the freezing plates for ice making.

14 Claims, 5 Drawing Sheets

MODULAR ICE MACHINE

BACKGROUND OF THE INVENTION

This invention relates to a completely self contained modular industrial ice machine. More specifically, the present invention concerns a method and apparatus for making clear fragmented ice from one or more serpentine type ice plates contained in the preferred embodiment within a high density, stress relieved, food grade polyethylene thermoplastic insulated modular box ice machine.

One of the most economical methods of making large quantities of clear ice is by using large surface serpentine type ice plates. Hundreds of commercial and industrial ice making machines in use today utilize this serpentine type ice plate. All of these commercial and industrial ice machines require substantial initial investments for equipment, tooling and labor. Manufacturing these machines requires equipment such as shears, punch presses, automatic strippit machines, foaming units for panels, jigs, special hand tools, an assortment of large and small press breaks and large welders. Further, these machines require tens of thousands of square feet of manufacturing space for proper production. The freezing plates used are normally of the serpentine type and placed in angle frames, square tube frames, sheet metal frames and frames of various other shapes and sizes. This type of plate is made of stainless steel and therefore normally lasts for indefinite periods of time. Indeed, what usually causes the various ice machines in this field to stop operating is rusting of the evaporator frame. The evaporator frame normally rusts out due to excess moisture and condensation.

The various models of ice machines on the market today have a significant number of valves, connections and joints which are associated with the making and defrosting of the ice. These include check valves, solenoid valves, desuperheating valves, auxiliary thermal expansion valves and others. Water and condensation often runs into electrical boxes resulting in burned out coils, electrical shocks and the need for constant maintenance and replacement of necessary operating components. This type of maintenance results in thousands of hours of down time replacing valves and tracing electrical shorts. The present invention comprises no electrical connections associated with the making and defrosting of clear ice sheets and further eliminates water connections located in the same enclosure where condensation corrodes the operating elements.

Many ice machines on the market today have frames which require the chipping of slag, buck shot grinding, and other labor exposing welders to eye injuries and the possibilities of hand and foot injuries. Frames built presently in the industry require sheet metal panels that can total as many as twenty seven different sizes and require a full scale sheet metal shop of approximately twenty men and approximately two million dollars worth of equipment for proper installation and manufacturing. In that the various components, more particularly the walls of other ice machines, must be hot dipped galvanized or constructed of sheet metal, sharp edges about the periphery of the unit are often exposed. Further, the sheet metal strips must be individually cut to specifications thereby leaving significant amounts of excess material wasted. In light of the foregoing problems, it is clear to those of ordinary skill in the art that there is an existing need for ice machines which overcome these problems in an economical and space saving fashion.

Other ice machines which utilize serpentine type freezing plates utilize ice slides which run substantially perpendicular to the plates and often contain rivets, screws, braces or hat sections which will cause ice to hang up during defrost. The polyethylene thermoplastic insulated ice slides of the present invention run at a substantially oblique angle to the serpentine freezing plates and are free of the above mentioned encumbrances.

The present invention incorporates an integrated water tank. As opposed to the standard practice, the present invention does not contain a water pump connection using a separate bushing type connection. The present invention comprises a clean-out and drain hole on the bottom of the water tank which is drilled and tapped. It is also standard in other industrial ice machines to find significant amounts of distribution piping, water distribution tubes, distribution flow valves and other hardware associated with distributing the water about the freezing plates. The present invention substantially eliminates excess piping and tubing by employing a single hydrostatic distributor manufactured of food grade polyethylene. This also eliminates stagnated water while the ice machine is off such as may occur when employing the apparatus described and claimed in U.S. Pat. No. 4,192,151 issued to Carpenter. Traditionally, the stainless steel serpentine freezing plates are installed one at a time using two or three laborers. The water distribution system also traditionally utilizes complicated angles and multiple sets of holes corresponding to the individual plates. Due to the angles and overall complicated system, water often stagnates when the system is not in use.

Some prior art ice-making devices freeze water to make ice and then also use water and/or hot gas for defrosting. When water is used for defrosting the water must have a temperature of at least sixty-five degrees fahrenheit (65°) therefore, an auxiliary water heater and a blending valve are often required for such ice machines. This present invention utilizes a hot gas defrost method for the most efficient defrosting of ice from the stainless steel freezing plate assembly. With other various hot gas defrosting methods hot gas normally comes from the compressor passing through numerous check valves, suction solenoid valves, and suction line check valves before entering the freezing plates. What starts out as hot gas often condenses into up to fifty percent (50%) liquid by the time it reaches the freezing plates because of the pressure drops encountered while flowing through the various valves mentioned above. This fifty-fifty mixture must still travel through the freezing plates thereby creating more condensed liquid returning from the freezing plates and a defrost cycle of three minutes or greater. Eventually, this liquid condensation ends up at the compressor and is commonly known as "liquid slug", causing instant internal destruction of the compressor's valve plates and piston chambers. The present invention uses hot gas which travels directly from the compressor to the desuperheater header and enters the freezing plates equally with no interruptions thereby eliminating pressure drops and substantial condensation.

Finally, the prior art machines must normally be set over expensive grated pit areas for the purpose of controlling dripping water from the ice machines where designed ice sizers, ice crushers and their hardware assembly penetrate through the ice machines external panels. Where the penetration is located one can normally find leaks.

In light of the kinds of problems set forth above it will be apparent to those skilled in the art that there continues to exist a need for ice making machines which overcome those kinds of problems, as well as others.

Accordingly, it is an object of the present invention to provide a new and improved industrial ice making machine.

It is another object of the present invention to provide a new and improved modular and completely self contained ice machine.

Yet another object of this invention is to provide a new and improved modular and completely self contained ice machine which comprises parts that may be easily inserted and removed allowing improved accessibility to the mechanical features of the ice machine.

Still another object of the present invention is to provide a new and improved modular industrial ice machine manufactured of high density, stress relieved, polyethylene, food grade, thermoplastic material.

Another object of this invention is to provide a new and improved modular industrial ice machine manufactured of high density, stress relieved, polyethylene, food grade thermoplastic material being resistant to hundreds of known chemical reactants and being totally nonconductive and noncorrosive by nature while utilizing only F.D.A. and U.S.D.A. approved material for the ice making process.

Another object of the present invention is to provide a new and improved modular ice machine which eliminates any and all damage due to undesired condensation, drippage, corrosion, and rust from the ice machine regarding internal and external elements.

Yet still another object of the present invention is to provide a new and improved modular ice machine which allows flexibility of design utilization without the need to specifically change the basic design concept for specific applications.

Another object of the present invention is to provide a new and improved modular ice machine which greatly reduces manufacturing time and cost.

Another object of the present invention is to provide a new and improved high density, stress relieved, polyethylene, food grade, thermoplastic hydrostatic distributor providing a controlled water flow to the new and improved design stainless steel freezing plates.

Still another object of the present invention is to provide a new and improved modular ice machine featuring a stainless steel freezing plate that allows for 100% of the freezing surfaces on both sides to be utilized for the freezing of clear ice sheets.

Another object of the present invention is to provide a new and improved modular ice machine featuring a stainless steel freezing plate that allows for a top refrigerant inlet and bottom refrigerant outlet resulting in the elimination of trapped fluids during operation.

Yet another object of the present invention is to provide a new and improved modular ice machine featuring a stainless steel freezing plate design that results in no pressure drops during operation providing equal flow of refrigerant internally throughout all 12 serpentine pass areas of each stainless steel plate.

Another object of the present invention is to provide a high density, stress relieved, polyethylene, food grade, thermoplastic modular box ice machine compactly capable of housing one to twenty stainless steel freezing plates.

It is still another object of the present invention to provide a new and improved modular ice machine capable of producing one to twenty tons of clear and sanitized sheet ice in twenty four hours of operation.

Another object of the present invention is to provide a new and improved desuperheater header distributor which will distribute the cold and hot gases equally to the freezing plates at the appropriate times for uniform freezing and defrosting comprising a single unit of much greater simplicity than the previously used distribution systems.

Yet another object of the present invention is to provide a new and improved modular ice machine featuring the simplicity of a designed defrost cycle which eliminates many regulating valves of various sizes and purposes per operating system.

Another object of the present invention is to provide a new and improved modular ice machine incorporating an integrated water recirculating tank.

Another object of the present invention is to provide a new and improved modular ice machine featuring a round section of thermalplastic tubing cut along a center line groove and affixed atop each stainless steel freezing plate's edge allowing an improved distribution of water over the entire freezing surfaces of the stainless steel plates.

Still another object of the present invention is to provide a new and improved modular ice machine which greatly reduces the overall total number of ice making components needed for a single self contained ice making unit.

SUMMARY OF THE INVENTION

The industrial modular ice machine described herein comprises a relatively few number of components all of which may be slidably removed from the machine for ease of assembly, cleaning and repair. The modular ice machine itself is manufactured of any type of thermoplastic insulating material. More specifically, the box can be manufactured of high density, stress relieved, polyethylene, food grade, thermoplastic material which is cut into four rectangular sheets and two square sheets each approximately one half the size of the rectangular sheets. The present invention can be manufactured to a standard size. This allows for manufacturing for installation without the necessity of multiple design changes.

It is the design of the present invention which distinguishes it from any other ice machine presently known. The modular box ice machine is manufactured by utilizing standard four by eight foot high density, stress relieved, food grade, polyethylene thermoplastic sheets. Only five (5) sheets are needed in order to manufacture the outer frame for each machine. Internally, the same material is used for the hydrostatic distributor, freezing plate supports, thermoplastic ice slides, thermoplastic conveyor trough and screw section. The resulting invention being four foot square and eight foot high can be turned three hundred sixty degrees (360°) to accommodate any and all desired ice delivery situations. Further, the polyethylene thermoplastic ice slides are of a one piece construction each and have no rivets or screws to interfere with the ice falling during the defrost cycle as opposed to the other machines presently known and manufactured. The manufacturing of this modular box ice machine results in a savings of approximately ninety five percent (95%) of the electrical costs used to manufacture ice machines presently known in the art. Further, the present design is intended to eliminate any and all damage due to undesired dripping and corrosion from the ice machine to external areas around the operating system.

Other various ice machines must be set up over expensive grated pit areas for the purpose of controlling dripping water from the ice machines normally penetrating the ice machines external panels and at the points of connection with other panels. The present invention can be constructed such that there is an elimination of any and all water coming from the modular box ice machine during operation.

The modular box ice machine of the present invention has demonstrated an extraordinary application in the industrial ice manufacturing area. This machine also is applicable in the commercial ice making industry, industrial ice making/storage industry, as well as the thermal ice storage and chilling industry. The design provides for no electrical connections associated with the freezing or defrost cycles of this modular box ice machine.

The present invention allows a substantial savings in labor, materials and overall manufacturing costs while producing a more efficient machine which produces higher quality ice than has been known previous to this time in the art.

DESCRIPTIONS OF THE DRAWINGS

DETAILED DESCRIPTION OF THE PREFERRED EMBODIMENT

Figure 1:
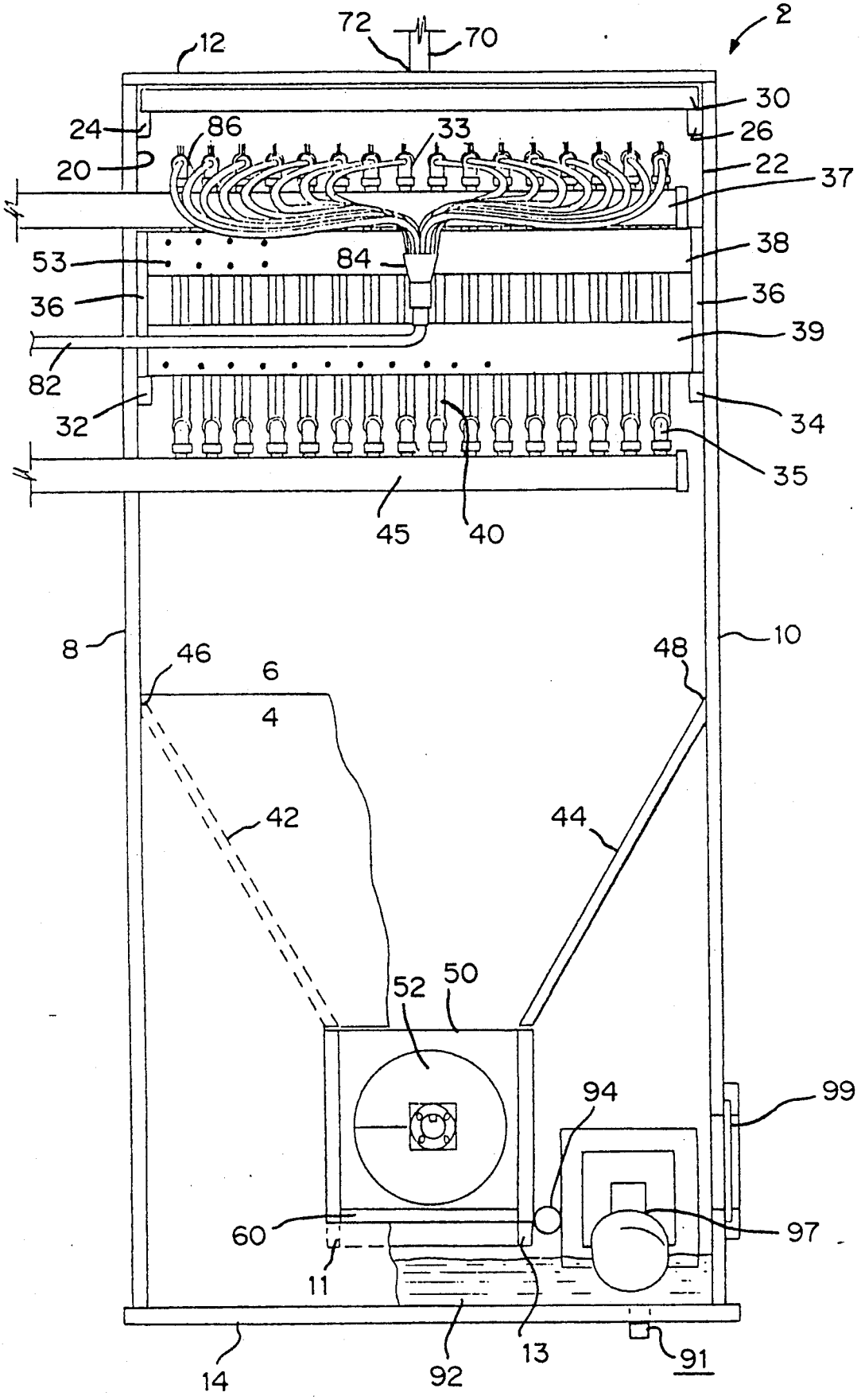
FIG. 1 is a front view of the preferred embodiment of the present invention.

FIG. 1 shows the modular box ice machine 2 described and claimed below. As shown in FIG. 1, the modular box ice machine 2 of the present invention includes four (4) rectangular sides, front, back, left and right sides, 4, 6, 8 and 10. These sides, as well as the top and bottom sections 12 and 14, are preferably manufactured of a food grade thermoplastic material such as a high density, food grade polyethylene. Manufacture of the box with this material provides for a lightweight, solid, nonconductive, noncorrosive industrial ice making machine. The thickness of the polyethylene is preferably one inch thick but can be more or less thick depending on the specifications for the unit, i.e. the ice making capacity and refrigeration specifications required for the particular use for which the machine is intended.

Figure 2:
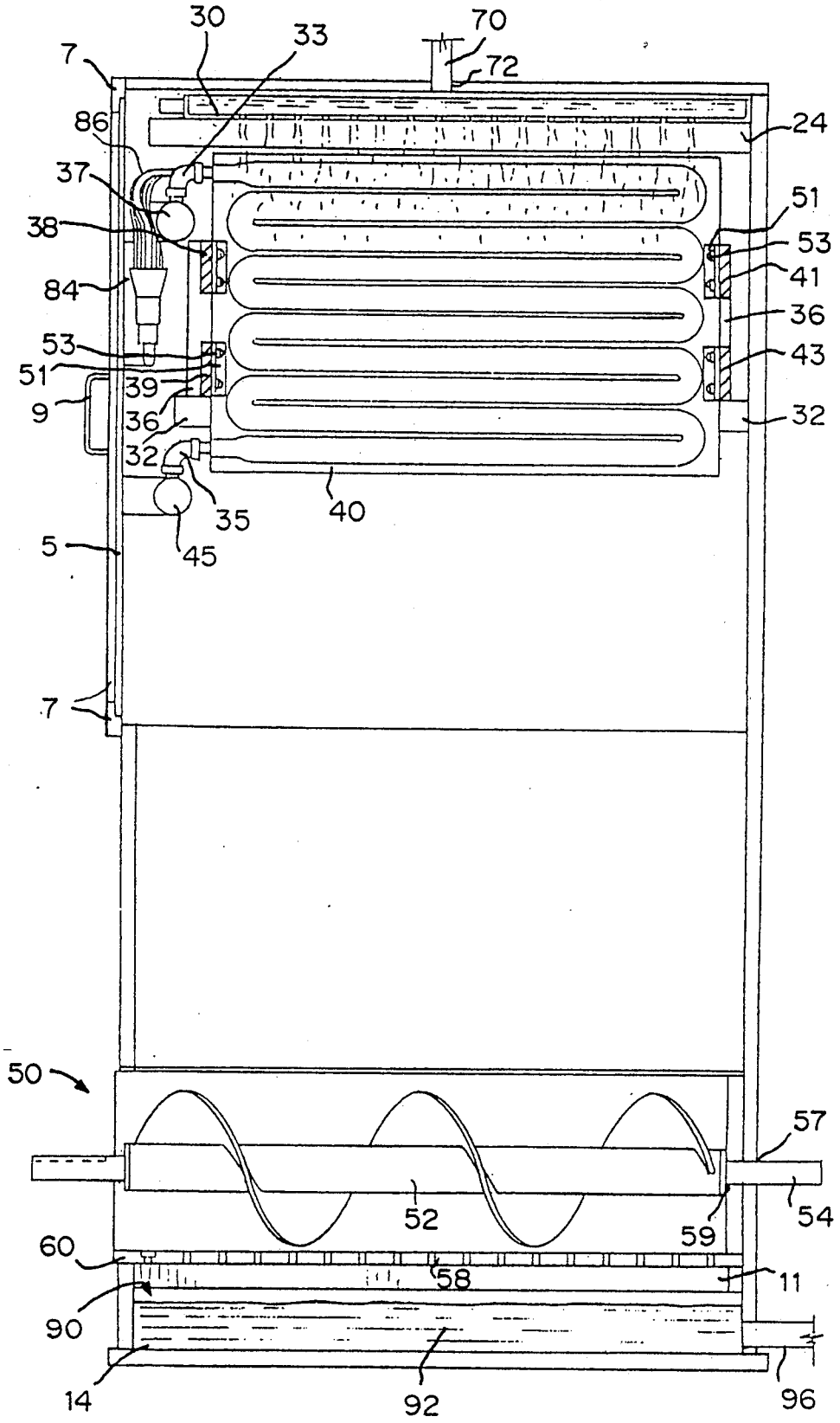
FIG. 2 is a side view, partly in section, of the preferred embodiment of the present invention.

The present invention requires assembling two side panels 8 & 10 and rear panel, 6 while leaving the front panel 4 open. Alternatively, the front panel 4 can be cut into two sections, top and bottom, each four feet by four feet with the bottom half being assembled to the unit and the top half remaining unassembled until the internal construction is completed. Additionally, as shown in FIG. 2 the top panel can be replaced with a lexan window panel 5 fixably or removably mounted by using a boarder mounting structure 7 with fixably attached handles 9.

The panels 4, 6, 8 and 10 are assembled such that the points of connection are water tight. Internally, a plurality of supports must be fixably attached to the inside walls 20 and 22 of the left and right side panels, 8 and 10 of the ice machine 2. The supports will accommodate the various internal elements of the ice machine which are to be slidably mounted within said machine. From top to bottom, the first set of supports 24 and 26 will accommodate the hydrostatic distributor 30. Traveling down the unit, the next set of supports 32 and 34 attached to the inside walls 20 and 22 respectively will accommodate the side support panels 36 for the freezing plate assembly. The freezing plate assembly includes the freezing plates 40, refrigerant inlet 37 with corresponding elbow conduits 33, support panels 36, 38, 39, 41 and 43, suction outlet 45 and its corresponding elbow conduits 35, hot gas inlet 82, desuperheater header 84 and hot gas distribution tubes 86.

Horizontal support panels 38 and 39 are fixably attached to freezing plates 40. Said attachments may be accomplished using "L"—brackets 51 as shown which are bolted 53 to support panels 38 and 39. Both support panels 38 and 39 are attached longitudinally perpendicular to the freezing plates 40. Located on the opposite side of the plates 40 from supports 38 & 39 are corresponding support members 41 and 43, more easily seen in FIG. 2. Side support panels 36 fixably attach to members 38 and 39 as well as their corresponding supports 41 and 43 located on the opposite side of the freezing plates 40. Upper support members 38 and 41 are attached just below the refrigerant inlet pipe 37. The refrigerant inlet pipe 37 in turn, is connected to the freezing plates 40 at a perpendicular angle thereto via elbow conduits 33 and immediately below and parallel to the tops of said plates 40. The lower support members 39 and 43 are connected perpendicularly to the freezing plates 40 using similar "L" brackets 51 and are parallel to the upper supports 38 and 41 and immediately above the bottom of the freezing plates 40. The support members 36 are not fixably attached to the supports 32 or 34 thereby allowing the entire freezing plate assembly to be slidably inserted into and removed from the modular box ice machine of the present invention.

Attached to inside walls 20 and 22 respectively are ice slides 42 and 44. These ice slides are fixably mounted at points 46 and 48, said points being intermediate between the top and bottom of the modular ice box 2. The ice slides 42 and 44 are mounted such that they are at an oblique angle to the freezing plates 40. The ice slides are continuous from their respective walls to the ice conveyor 50. This allows for the ice, once defrosted, to fall directly from the freezing plates 40 to the ice slides 42 and 44 and in turn slide and fall directly into the ice conveyor 50. The ice conveyor 50 is preferably of the auger type comprising an internal thermoplastic auger 52 rotatable about its cylindrical support axes 54 and supported by a cylindrical channel 57 in the back panel 6 of the ice machine 2 which corresponds to a similar channel 59 found in the internal end of ice conveyor 50 wherein the axis 54 rests. However, any other type of conveyor system can be used. The conveyor 50 is used to transport the ice from the ice machine to the desired external location or ice storage unit.

As can be seen more clearly in FIG. 2, the conveyor is mounted transversely from rear panel 6 through front panel 4 and rests on supports 11 and 13. A plurality of drain holes 58 are located across the bottom of the ice conveyor floor 60. The drain holes 58 allow for ice particles which are too small to be carried out through the conveyor and any meltings from the ice sheets being formed above to fall through the conveyor 50 and its floor 60 to the bottom 14 of the modular box ice machine 2. The conveyor 50 is mounted just above the modular box ice machine floor 14, preferably eight to ten inches.

Figure 3:
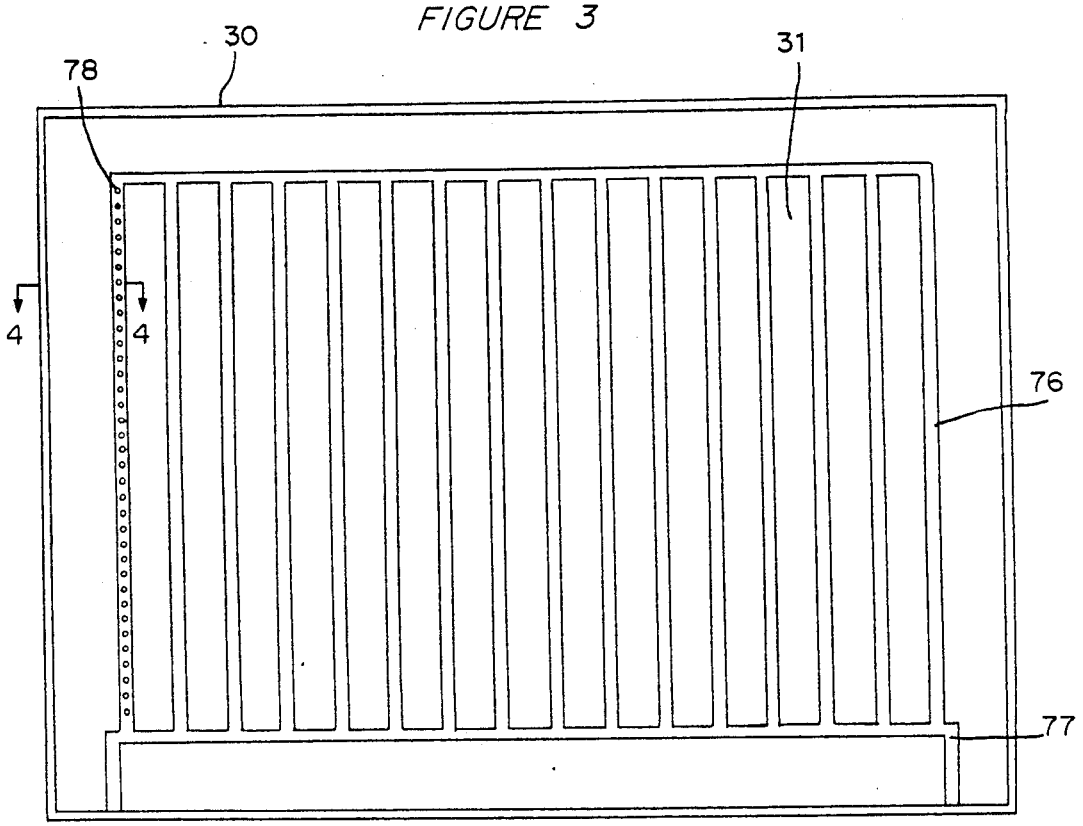
FIG. 3 is an overhead plan view of the hydrostatic distributor of the preferred embodiment of the present invention.
Figure 4:
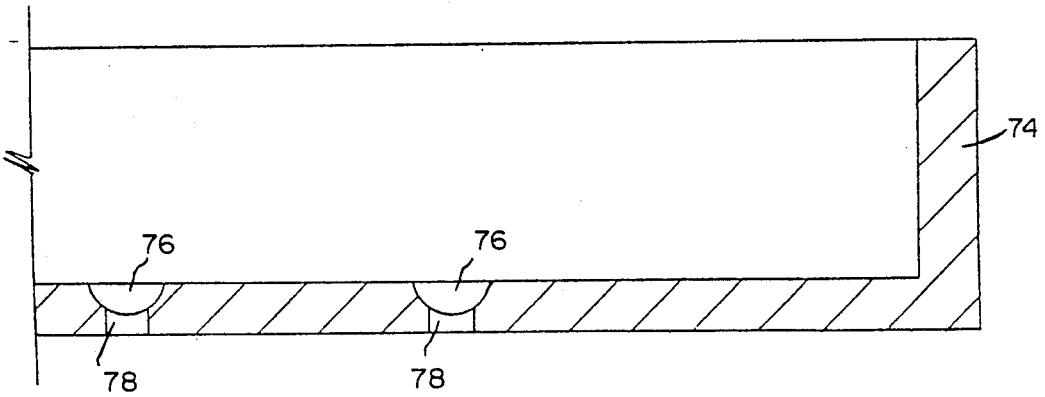
FIG. 4 is a cross sectional view of the hydrostatic distributor of the present invention taken along line 4—4 of FIG. 3.

The ice making water is introduced into the system through the ice making water inlet tubing 70. This inlet tubing passes through the ice machine top 12 through port 72. The water flows through the inlet tubing 70 into the hydrostatic distributor 30, as more clearly seen in FIGS. 3 and 4. The water flows into the hydrostatic distributor 30 and is then distributed throughout the drain pan 31 via various distribution tributaries 76. The tributaries 76 are substantially parallel to each other and connected on each end by a similar perpendicular canal 77. The tributaries 76 running from front to back are spaced equidistantly apart and one each is located immediately above each freezing plate 40. Each tributary 76 contains a plurality of small drain holes 78 which allow the water to fall evenly from the hydrostatic distributor 30 onto the thermoplastic tubing 74 attached longitudinally atop each of the freezing plates 40. The tubing 74 allows the water to flow evenly over both sides of the plates 40 and further allowing ice to form equally on both sides of each freezing plate 40. The ice forms due to the refrigerant gas being pumped into the freezing plates 40 through the refrigerant inlet tube 37 and into the plates via the individual distribution tubes 33.

Once the ice has formed, normally after 20 minutes, a solid state timer 101 signals the machine to defrost. At this time, the water pump 100 which was supplying the hydrostatic distributor 30 with the ice making water shuts off, the polyethylene thermoplastic auger 52 of the ice conveyor 50 starts and the hot gas valve 102 opens supplying hot gas to the freezing plates 40 via the hot gas distribution header, or desuperheater header, 80 which is more clearly seen in FIG. 5. The hot gas enters the desuperheater header 84 via the gas inlet tubing 82. The gas inlet tubing connects to the desuperheater header 84 which in turn directs the incoming hot gas to a plurality of equal length tubes 86, preferably ¾'s of an inch in diameter, which extend from the header 84 through the refrigerant inlet distribution tubing 33. More specifically, the hot gas distribution tubes 86 pass into the individual refrigerant providing elbow conduits 33 which extend from the refrigerant inlet tube 37 into the freezing plates 40 thereby allowing the hot gas into the various freezing plates 40 for defrosting. Once the hot gas is injected into the freezing plates 40, the ice sheets which have formed on each side of the plates 40 will defrost and fall onto the ice slides 42 and 44 and into the ice conveyor 50. The refrigerant and hot gas, after being alternately injected into the freezing plates, are removed through the suction outlet 45.

As shown in FIG. 1 and FIG. 2, the lower bottom section 90 of the modular box ice machine 2 stores the recirculating water 92 to be used as the ice making water. The recirculating/ice making water 92 is generated by the meltings by the ice formed by the freezing plates 40 and local tap water. The meltings from the freezing plates as well as the meltings from the small ice chips, which are generated during the defrost cycle wherein the ice sheets fall from the freezing plates 40 onto the ice slides 42 and 44 as well as the ice conveyor 50, fall through the ice conveyor holes 58 to the bottom of the ice machine 2. The ice shavings and meltings are combined with tap water which enters the recirculating/ice making water tank section 90 of the ice machine 2 through the tap water inlet 94. A float shut-off valve 97 is used so that once the proper amount of water has been accumulated the tap water inlet is shut. A lexan porthole 99 is located in the lower section 90 of the ice machine 2 to allow an operational view of the inside of said machine 2 and allow an access to the internal parts such as the float valve 97 is necessary. A clean-out drain hole 91 may also be drilled and tapped as shown for draining purposes.

Figure 5:
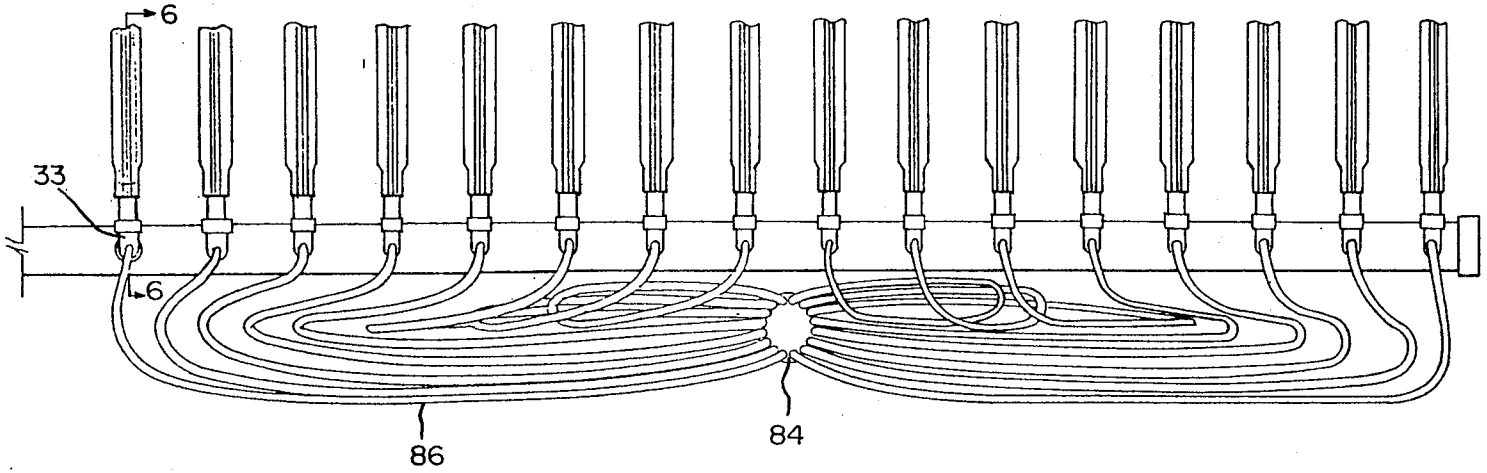
FIG. 5 is an overhead plan view of the desuperheater header of the preferred embodiment of the present invention.
Figure 6:
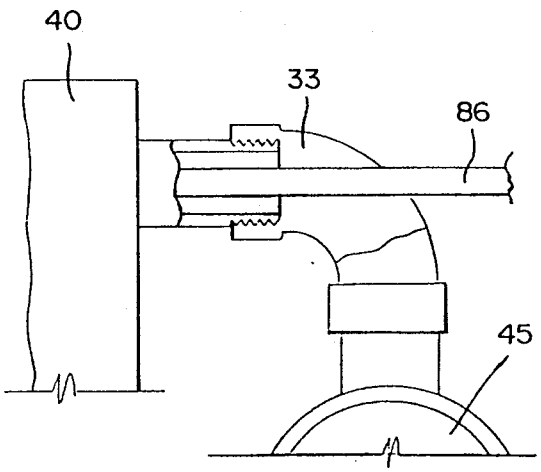
FIG. 6 is a side view, partly in section, of the desuperheater header of the preferred embodiment of the present invention taken along line 6—6 of FIG. 5.
Figure 7:
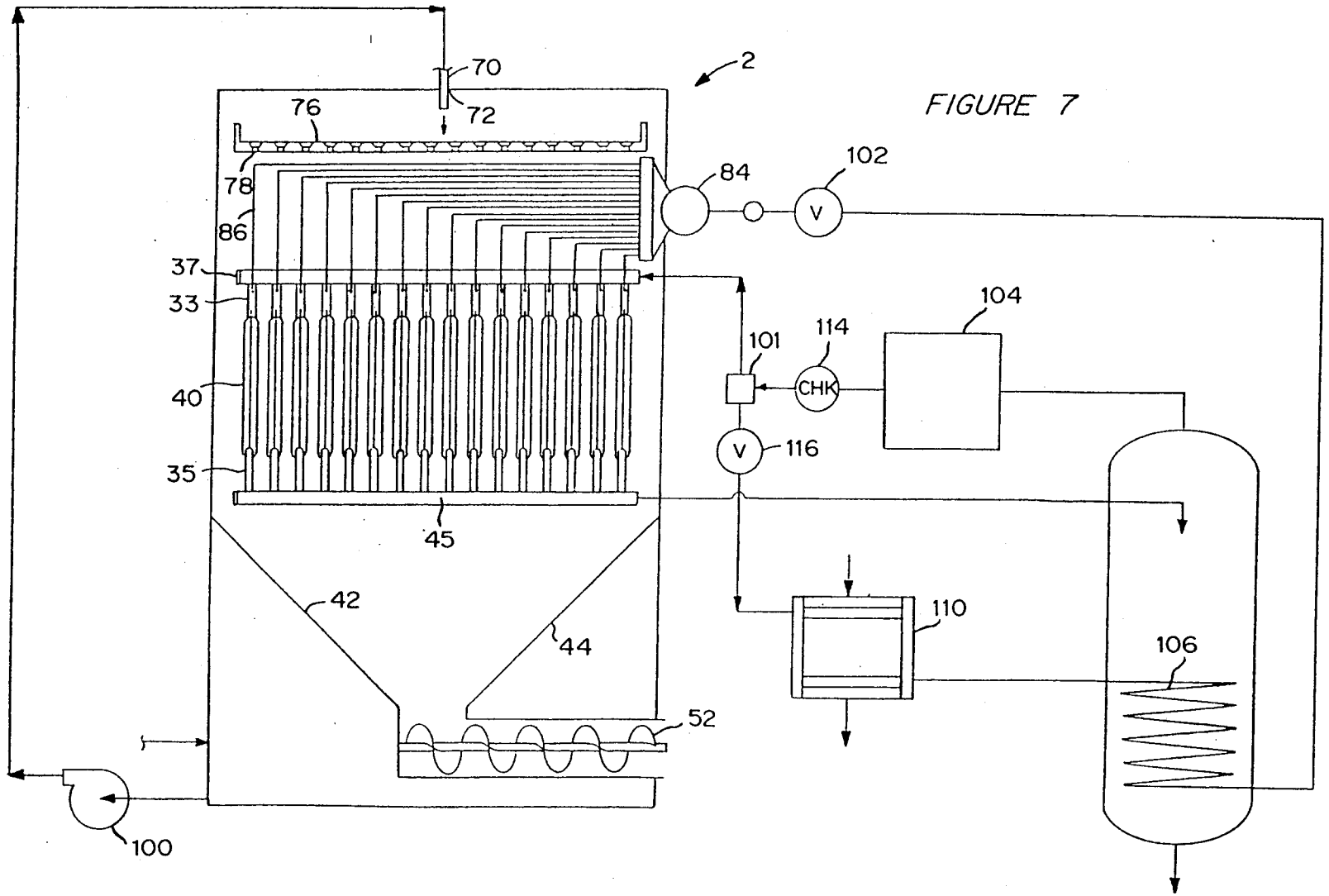
FIG. 7 is a schematic diagram illustrating the process of the present invention.

The recirculating ice making water 92 is pumped out of the tank portion 90 through the recirculating/ice making water outlet 96. This water is pumped directly up to the ice making water inlet 70 and into the hydrostatic distributor 74. As the water runs down the plates 40, sheets of ice start to appear on the surface of the freezing plates 40. The ice forms since the compressor 104 is running freon gas equally into the freezing plates through the refrigerant inlet 37, said refrigerant being distributed equally into the individual plates via the individual freezing plate refrigerant inlet tubes 33 as seen in FIGS. 5, 6 and 7. The refrigerant is boiled off inside the freezing plate 40 and a certain amount of liquid as well as refrigerant vapor travels out of the freezing plates 40 through the suction header 41. The excess liquid is dumped into an accumulator 106 while the refrigerant vapor is drawn off the top of the accumulator vessel 108 and travels to the compressor 104. The compressor 104 then takes the low pressure vapor, compresses it and increasing both the pressure and the temperature. This hot high pressure gas is then forced out from the compressor 104 through check valve 114 and hand valve 116 into the water cooled condenser 110. The hot high pressure gas is then formed into a liquid of approximately 95° fahrenheit. This liquid is then transferred from the condenser 110 to the accumulator 106 in a closed loop inside the accumulator. The accumulator using freon cools the liquid which entered at 95° to a minimum of 60° and maximum of 75° fahrenheit. This cool liquid and the freon then passes into the refrigerant inlet means 35 through the refrigerant distribution tubes 33 and into the freezing plates 40. The liquid passes through the distributor header tubes 35 and 33 which are sized to reduce the pressure from 150 PSI to 60 PSI. This drop provides approximately 80% liquid spray and 20% gas mist into the freezing plates and at that point have a PSI of between 30 and 37. Meanwhile the refrigerant gas is traveling with the liquid through the serpentine freezing plates 40. After the gas travels through the plates 40, liquid and gas travel into the suction line 41 and the process begins again. This process is diagramed in FIG. 7.

Every 20 minutes a solid state timer 101 signals the beginning of the defrost cycle. At this time, the water pump 100 which is pumping the recirculating/ice making water 92 up and through the water inlet 70 into the hydrostatic distributor 74 turns off, the ice conveyor 50 starts and hot gas from the compressor 104 is funneled into the desuperheater header 84 through the hot gas inlet 28. The hot gas is then distributed to the distribution tubes 86 via the distribution piece 85. The hot gas is later removed from the freezing plates 40 through the section header 45 and deposited in the accumulator 13. This entire process is shown in FIG. 7.

In operation the preferred embodiment comprises four rectangular sheets of thermoplastic material are arranged such that when the joints are fixed, the final result is a rectangular boxed-shaped modular industrial ice machine. The edges are fixably attached using stainless steel screws. The manufacturing of the present invention is relatively simple. The most significant components include only rectangular and square sheets of thermoplastic material. The sheets are light-weight, sturdy and posses good insulation qualities. This type of material has been FDA and USDA approved.

The four feet by eight feet standard polyethylene thermal plastic sheet is nonconductive, noncorrosive, and resistant to approximately 400 chemicals. By using standard four by eight foot sheets the present invention can be manufactured without wasted material. Each wall will be comprised of the standard four by eight foot sheets with the top and bottom each four by four made utilizing one half each of a standard four by eight foot sheet.

The bottom of the modular industrial ice machine being made of the high density, food grade thermal plastic material becomes an insulated water recirculating tank and is integrated with the total box. Indeed, the four sides of the water tank are the same four sides of the modular box.

This present invention's high density, stress relieved, polyethylene, food grade, thermoplastic, insulated, modular designed ice machine produces from (1) to (20) tons of clear quality, ⅛ inch to 1 inch thick, ice per 24 hours of operation per (1) to (20) stainless steel freezing plates installed. A total of forty clear ice sheets can be produced per refrigeration cycle. The stainless steel freezing plates are of a serpentine type and hang substantially perpendicular in the top half of the modular box. The freezing plates are preferably 304 stainless steel, 16 gauge, incorporating 12 serpentine passes per plate design with overall dimensions being 30 inches by 36 inches having an effective freezing surface measuring 27.5 inches by 33.75 inches per plate. The complete internal refrigerant pass area height is preferably within 15/1000ths of each and every serpentine pass area concerning each manufactured stainless steel freezing plate utilized within the stainless steel freezing plate assembly. Normally, the internal pass area is 0.232 and the exterior height is 0.350. This plate design has a top inlet refrigerant feed and a bottom outlet eliminating trapped fluids during operation. Problems experienced in the field with other various types of plate designs result in an erratic internal refrigerant flow pattern effecting desired freezing and defrost times due to internal pressure drops within the internal pass areas. Also, excessive water flowing over other types of external freezing surfaces causes water to splash and ice to build up on the excessive stainless steel freezing area of the plate's outer perimeter. This is a major problem effecting the unit's next refrigeration cycle and the extra built-up ice cannot be automatically defrosted without manual labor required to properly remove undesired ice build-up. This unit's stainless steel plate assembly design completely eliminates the problems experienced with these other freezing plate designs. The entire stainless steel assembly is designed to easily slide into the upper four foot square portion of the modular box.

Located immediately above the freezing plates is the hydrostatic distributor. This water distributing basin is also constructed of thermal plastic material and manufactured to slide in and out of the ice machine itself.

The hydrostatic distributor contains various tributaries which channel the water being pumped into its drainage basin. A plurality of apertures are located immediately above and parallel to the freezing plates. The water is pumped into the drainage basin and directed immediately above the freezing plates and dripped in a measured fashion onto polyethylene plastic crowns affixed atop each freezing plate's edge. As the water flows evenly onto the plates surfaces the ice sheets are formed on both sides of the freezing plates.

Once the ice sheets are formed on the freezing plates the defrosting cycle begins. At this time the water pump shuts off, the screw conveyor starts and the hot gas valve opens and sends gas directly to the hot gas desuperheater header which in turn distributes the gas to the plates. The sheets then fall from the freezing plates on to the ice slides or polyethylene ice conveyor transport and accommodating trough (ice removal system). This conveyor is preferably of the auger type with a perforated bottom to allow water which is melted from the ice to seep through the trough to the bottom of the box.

The present invention requires only two flow lines connected to the freezing plates. This is due to the desuperheater header used to distribute the refrigerant and hot gas. During the ice making cycle, the ice sheets are formed when cold, low pressure, refrigerant flows through each individual serpentine ice plate as the water drips from the hydrostatic distributor to the plates. When the modular box ice machine goes into the defrost cycle, there is one and only one automatic hot gas solenoid valve that needs to open or close during the complete ice making and defrost cycle. Once this valve opens, the hot gas is equally distributed throughout the freezing plates, thereby defrosting and allowing the ice sheets to fall into the ice removal system.

The present inventions stainless steel freezing plate assembly can be picked up with the suction header, used to remove the refrigerant or hot gas, and liquid desuperheater hot defrost header and easily slides into or out of the modular box ice machine. The freezing plate/-header assembly slides into or out of the modular box ice machine on at least two plastic insulated pieces mounted to the inside walls.

Unlike the traditional designs, the present invention, in its preferred embodiment, requires only one individual brazing the suction header and liquid hot gas desuperheater header onto the stainless steel plates. With the present invention the liquid desuperheater header, being one part in assembly, is brazed onto the freezing plate assembly on the work table. Using this method, the complete stainless steel freezing plate assembly can be leak checked in a one step dipping process. This contrasts to individually leak checking the traditional assembly at each brazed joint. This apparatus thereby eliminates approximately eighty percent (80%) of all inferior welds. Further, the entire twenty freezing plate assembly can be picked up and easily slid into place within the modular box ice machine of the present invention.

This invention contains a single drain hole in the bottom which is drilled and tapped verses the use of a separate bushing type connection normally found in various other ice machines. Further, the bottom of the present invention is angled in order to facilitate the water flow towards the drain. Being drilled and tapped directly into the polyethylene thermoplastic insulated bottom sheet insures the elimination of rust, corrosion and bacteria build up in the present invention. With the present invention, it is possible to maximally house twenty (20) stainless steel freezing plates overall, producing twenty (20) tons of clear ice in twenty-four (24) hours of operation.

What is claimed is:

1. An ice machine for manufacturing ice comprising:

a. A frame manufactured completely of a thermal plastic material composed of four sides, a top and bottom;

b. a hydrostatic distributor supported by said frame and freely movable in relation thereto;

c. at least one freezing plate supported by and slidably mounted within said frame adjacent said hydrostatic distributor;

d. a refrigerant gas inlet means for said freezing plate;

e. a hot gas inlet means for said freezing plate;

f. a combination hot gas/refrigerant outlet means for said freezing plate;

g. an ice making water inlet means into said frame and in communication with said hydrostatic distributor;

h. ice slide means mounted within said frame below and at an oblique angle to said freezing plate; and i. means for conveying ice from within said frame.

2. The ice making machine of claim 1, further comprising a means of recirculating melted ice and non frozen water from within said frame back to said hydrostatic distributor.

3. The ice machine of claim 1 further comprising a drilled and tapped drain hole located in the bottom of said frame.

4. The ice machine of claim 3 further comprising a sloped bottom of said frame, said slope in the direction of said drain hole.

5. The ice machine of claim 1 further comprising a tap water inlet located just above the bottom of said frame.

6. The ice machine of claim 1 further comprising a two piece side to said frame thereby allowing mounting of said hydrostatic distributor, freezing plate(s), gas inlet means and gas outlet means after initial construction of said frame.

7. The ice conveyor means of claim 1 further comprising an auger type conveyor.

8. The conveyor means of claim 1 further comprised completely of thermal plastic material.

9. The hydrostatic distribution pan of claim 1 further comprising a single flat water retention pan with a plurality of canals carved therein such that each canal contains a plurality of circular openings aligned directly above and parallel to each freezing plate.

10. The water distribution pan of claim 9 further comprised completely of thermal plastic material.

11. The ice machine of claim 1 further comprised of four sides, each four feet by eight feet and along with the top and bottom portions manufactured completely of thermal plastic material.

12. The ice machine of claim 11 wherein said top portion is comprised of a non-opaque material.

13. The ice machine of claim 1 wherein said ice slides are mounted such that all ice is directed into said conveyor means.

14. The ice machine of claim 1 wherein said freezing plates are manufactured completely of stainless steel.

* * * * *